United States Patent [19]

Reed

[11] 4,244,502

[45] Jan. 13, 1981

[54] DISPENSER FOR ROLL OF FLEXIBLE STRIP

[75] Inventor: Steven P. Reed, Felton, Calif.

[73] Assignee: Sven Iveter, San Jose, Calif.

[21] Appl. No.: 942,696

[22] Filed: Sep. 15, 1978

[51] Int. Cl.[3] ..... B65H 35/04; B26F 3/02

[52] U.S. Cl. ..... 225/13; 225/43; 225/52; 225/90; 225/106

[58] Field of Search ..... 225/13, 106, 77, 43, 225/52, 51, 90; 428/136, 43, 906

[56] References Cited

U.S. PATENT DOCUMENTS

| | | | |
|---|---|---|---|
| 453,003 | 5/1891 | Hicks | 428/43 |
| 1,122,673 | 12/1914 | Winter et al. | 225/106 |
| 1,704,044 | 3/1929 | Ingram | 225/106 |
| 2,328,109 | 8/1943 | Thompson | 428/43 |
| 3,655,501 | 4/1972 | Tesch | 428/136 |
| 4,047,652 | 9/1977 | Ehrlund | 225/90 X |

*Primary Examiner*—Frank T. Yost
*Attorney, Agent, or Firm*—Jack M. Wiseman

[57] ABSTRACT

A dispenser for a roll of strip comprising a casing in which is disposed a roll of strip. Pivotally connected to the casing is a cover. At the strip exit opening is a passage through which advances the free end of the roll of strip. Disposed in the passage for the advancing free end of the roll of strip is an upwardly extending indexing member. The indexing member is formed with a curved tip and tapered side walls that are directed outwardly and downwardly. The roll of strip is formed with curved slits. The curved slits are alternately convex and concave. The indexing member penetrates each slit successively. The convex slit forms a convex opening upon entering the ticket exit passage which is penetrated by the indexing member. The convex slit forms a concave opening upon entering the ticket exit passage which is penetrated by the indexing member. The convex slit, when opened, forms a tongue contacting the penetrating tip of the indexing member. The concave slit, when opened, forms a pocket which is penetrated by the tip of the indexing member. An operator applying a downward force to the free end of the roll of strip severs the free end thereof successively along each successive slit by means of sharp edges at the base of the indexing member.

12 Claims, 11 Drawing Figures

FIG_4
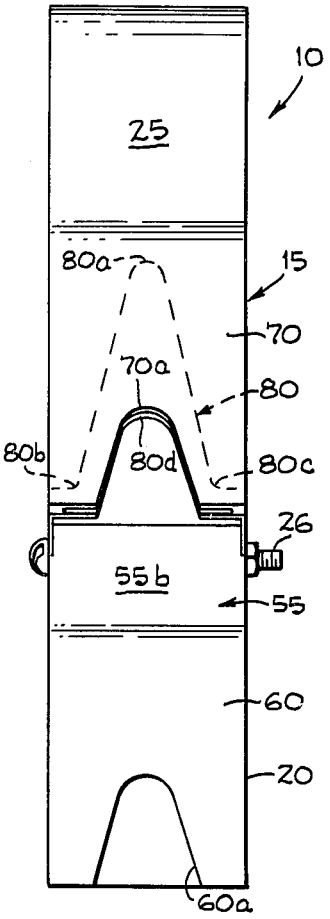
FIG_5
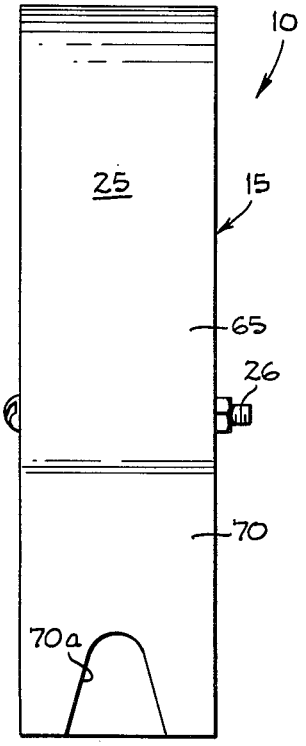
FIG_6
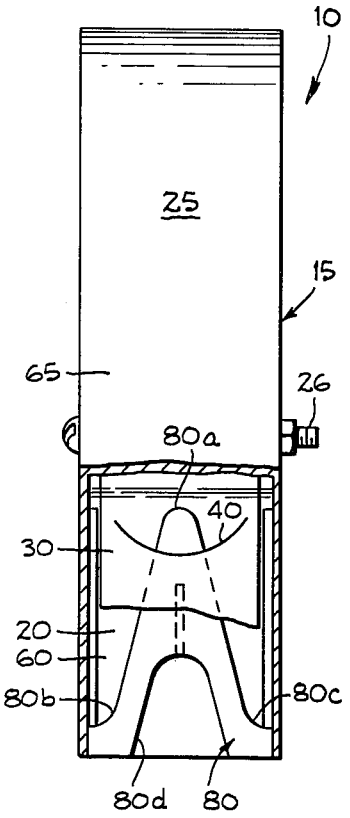
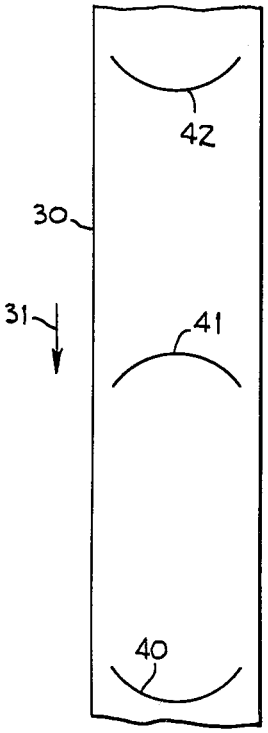
FIG_7
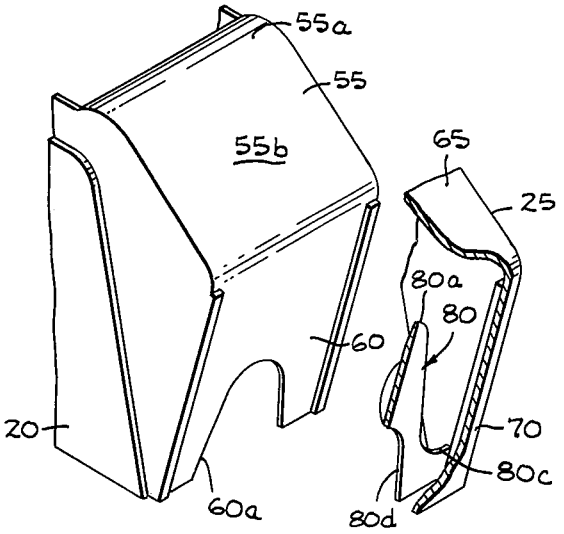
FIG_10

DISPENSER FOR ROLL OF FLEXIBLE STRIP

BACKGROUND OF THE INVENTION

The present invention relates in general to a dispenser for a roll of strip in which the free end of the roll of strip is to be removed from the roll of strip at a predetermined location.

The patent to Osborne, U.S. Pat. No. 3,229,876, discloses a dispenser for a roll of film. Perforations are formed transversely across the film at predetermined distances along the roll of film. The dispenser includes an arresting tab which penetrates the perforation following the strip to be removed from the roll of film. The arresting tab restrains rotation of the roll of film upon penetrating a perforation. An operator applying a force to the free end of the roll of film tears a strip from the roll of film along the transverse perforation.

Heretofore, dispensers for rolls of ticket tape have been employed in which a roll of ticket tape was disposed in the casing. A pivotally mounted cover closed the open top of the casing. The casing was formed with a flange over which the free end of the ticket tape advanced. The ticket tape was formed with tongues or flaps defining openings in the tape at predetermined distances therealong. By pulling downwardly on the tongue at the free end of the ticket tape, the tongue of the succeeding ticket to be removed would advance over the flange and the transverse edges of the exiting ticket adjacent the tongue of the succeeding ticket would be torn to remove the free end of the ticket tape from the remaining roll of tickets. Such a product was sold by AB Turn-O-Matic of Stockholm, Sweden, as the "Turn-O-Matic" dispenser.

S G T Enterprises of Santa Clara, California, sold a "Take-A-Turn" ticket dispenser in which the ticket tape had tongues or flaps at predetermined distances therealong defining openings in the ticket tape. An indexing flange projected outwardly from the casing. The tongue of the succeeding ticket to be removed advanced over the flange. The cover was formed with two depending tabs and a depending wall at the ticket exit. As the free end of the ticket tape was pulled by an operator, the tongue of the succeeding ticket to be removed bunched up to wedge between the depending tabs and the depending wall of the cover to restrain the movement of the roll of ticket tape. An operator applied a downward force on the tongue at the free end of the ticket tape, which tore the free end of the ticket tape from the remainder of the roll at the opening defined by the tongue of the succeeding ticket. This action was effected by the restraining action applied to the roll of ticket tape through the depending tabs and the depending wall; the downward force applied by the operator to the tongue at the free end of the ticket tape; and the frangibility of the roll of ticket tape at the opening defined by the tongue of the succeeding ticket to be removed.

In the patent to Ehrlund, U.S. Pat. No. 3,885,724, there is disclosed a ticket dispenser having a casing with an open top. A cover is pivotally attached to the casing to close the opened top of the casing. A roll of ticket tape is disposed in the casing. The ticket tape is formed with tongues or flaps defining openings in the roll of ticket tape at predetermined distances therealong. A flange projects outwardly from the casing over which advances the tongue of the exiting free end of the roll ot tape. On each side of the flange, the casing includes knife edges. An operator pulls downwardly on the tongue at the free end of the ticket tape. As the tongue of the succeeding ticket to be severed advances over the flange, the knife edges cut the ticket tape transversely at the opening defined by the tongue of the succeeding ticket to be removed.

The patent to Burr et al., U.S. Pat. No. 843,579, discloses a label dispenser for tearing off labels of the same predetermined length from a roll of labels. The roll of labels is formed with transverse slits at predetermined distances therealong. The casing is formed with a flange projecting outwardly therefrom that is curved in several directions. The cover includes a guide that overlies the flange to form a gap therebetween through which travels the free end of the roll of labels. A slot in the guide of the cover enables an operator to apply a downward force to the free end of the roll of labels. A spring in the casing applies a restraining force to the roll of labels. An operator pulling downwardly on the free end of the labels tears the free end of the label at the succeeding slit of the roll of labels by the restraining force applied to the roll of labels, the force applied at the free end of the labels, and the concentration of pressure applied to the roll of labels at the succeeding transverse slit by the curved flange.

In the patent to Ingram, U.S. Pat. No. 1,704,044, there is disclosed a dispenser for severing tickets from a roll of strip of predetermined lengths. The roll of strip is formed with transverse slits at predetermined distances therealong. The cover is formed with a flange which registers with the transverse slits for indexing the length of the strip to be removed from the dispenser. Knife edges on both sides of the flange sever the free end of the strip when the operator applies a force to the free end of the strip. A tension spring maintains the free end of the strip against the flange and the knife edges. A slot is formed in the cover to grip the free end of the strip.

The patent to Storm, U.S. Pat. No. 1,239,981, discloses a ticket dispenser in which projections engage notches of a ticket strip to index the strip at a tearing edge. The free end of the strip is severed by a knife edge.

In the patent to Wright, U.S. Pat. No. 2,023,829, there is disclosed an open sheet with curved openings to provide a window in a roll of tickets. Curved scoring on a roll of disposable bibs is disclosed in U.S. Pat. No. 3,583,558, issued to Davis on June 8, 1971. A patent to Tomlinson, U.S. Pat. No. 3,710,396, discloses a roll of dispensible head coverings with curved scoring.

SUMMARY OF THE INVENTION

A dispenser for a roll of strip comprising a container in which is disposed a roll of strip having slits disposed therealong at predetermined distances. At the strip exit opening of the container is located a passage for the advancement of the free end of the roll of strip. Disposed in the passage is a member that enters the slit of the advancing free end of the roll of strip for indexing the severing operation of the free end of the roll of strip at the entered slit. The member serves to sever the free end of the roll of strip at the entered slit when an operator applies a pulling force to the free end of the roll of strip, and the member serves to retard the egress of the strip of the roll of strip trailing the entered slit from the container when the operator applies a pulling force to the free end of the roll of strip.

A feature of the present invention is that the roll of strip is formed with curved slits. The curved slits are alternately convex and concave. The convex slits open at the ticket exit passage to form, respectively, a convex opening with a tongue contacting the tip of the indexing member when the indexing member penetrates the convex opening. The concave slits open at the ticket exit passage to form, respectively, a concave opening defining a pocket which is penetrated by the tip of the indexing member.

By virtue of the present invention, a less expensive dispenser is provided in that a single member performs the indexing operation, the severing operation and the restraining operation. Additionally, the roll of strip is more economical to manufacture in that the need for complex tongues or flaps on the roll of strip has been obviated.

DESCRIPTION OF THE DRAWINGS

FIG. 4 is a front elevation view of the dispenser shown in FIGS. 1–3 with the cover partially elevated.

FIG. 5 is a front elevation view of the dispenser with the cover in the closed position.

FIG. 6 is a vertical section taken along line 6—6 of FIG. 1 to illustrate the indexing, severing and restraining member of the dispenser shown in FIGS. 1–5.

FIG. 7 is a plan view of the free end of the roll of strip employed with the dispenser embodying the present invention.

FIG. 10 is a fragmentary exploded perspective view of the indexing member and strip exit passage employed in the dispenser shown in FIGS. 1–6, 8 and 9.

DESCRIPTION OF THE PREFERRED EMBODIMENT

Figure 1:
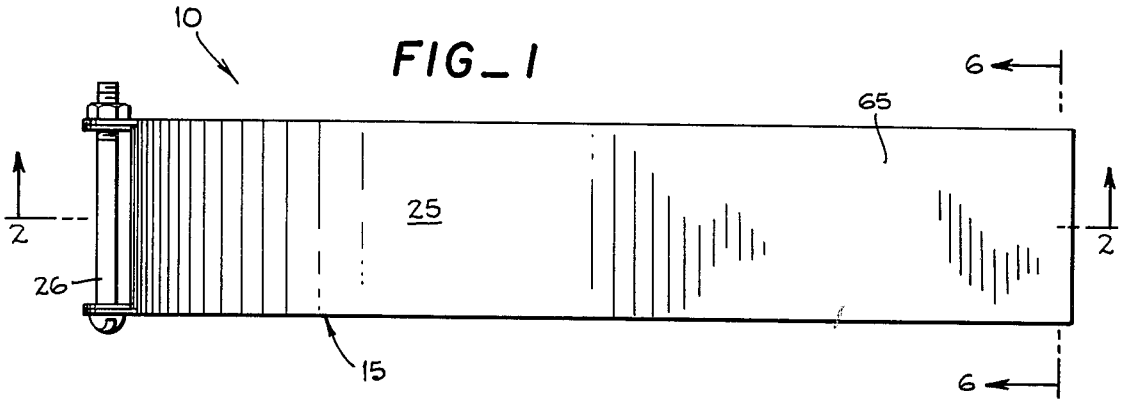
FIG. 1 is a plan view of a dispenser embodying the present invention.
Figure 2:
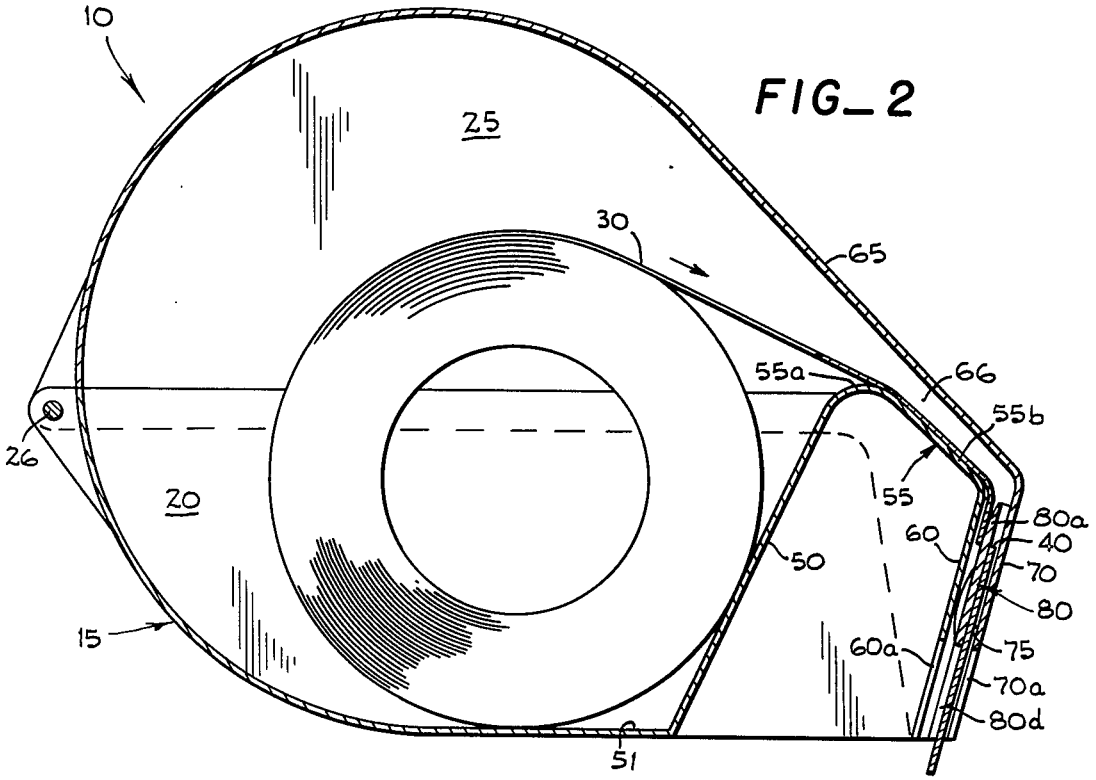
FIG. 2 is a vertical sectional view taken along line 2—2 of FIG. 1.
Figure 3:
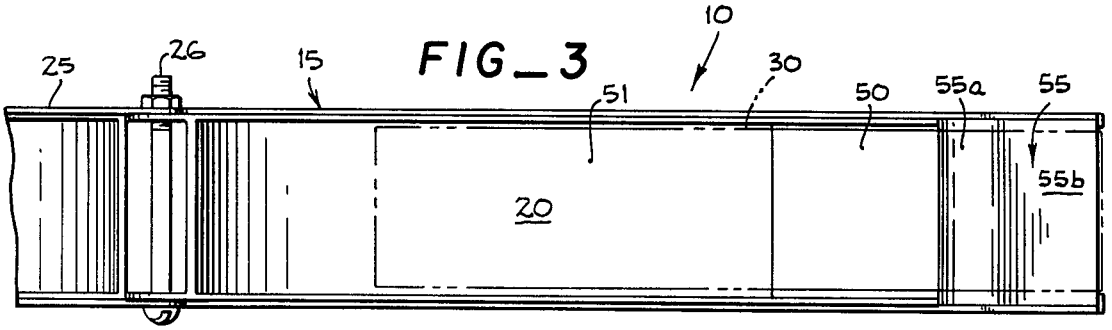
FIG. 3 is a fragmentary plan view of the dispenser shown in FIGS. 1 and 2 with the cover retracted to illustrate the casing thereof.

Illustrated in FIGS. 1 and 2 is a dispenser 10 embodying the present invention. The dispenser 10 comprises a container or housing 15. Forming the container 15 is a casing 20 and a cover 25. The upper part of the casing 20 is open. Pivotally attached to the casing 20 by a suitable hinge or pivot pins 26 is the cover 25. When the cover 25 is retracted or removed from the position covering the top of the casing 20, a roll of flexible strip 30 is removed from or inserted into the casing 20. During the operation of the dispenser 10, the cover 25 is fully closed. A suitable latch, not shown, serves to retain the cover 25 in the closed position suitable for the operation of the dispenser 10.

The roll of flexible strip 30 (FIG. 7) during the operation of the dispenser 10 has its free end advancing in the direction of the arrow 31 (FIG. 7) by the application of force by an operator. The roll of strip 30 is formed with curved slits 40, 41, 42, et cetera. The curved slits 40, 41, 42, et cetera, are spaced along the roll of strip 30 at predetermined distances. The slits 40, 41, 42, et cetera, are alternately convex and concave when viewed as travelling in the direction of the arrow 31.

The casing 20 comprises an upwardly and forwardly inclined wall 50, which forms a suitable chamber 51 for the roll of strip 30. Projecting forwardly of the wall 50 is a ramp or track 55 which has a curved wall **55*a* and a declining wall 55*b* projecting in the forward direction of the dispenser 10. At the ramp 55 is located the ticket exit opening of the container 15. Extending from the ramp 55 is a depending wall 60**.

Projecting from the cover 25 is a downwardly and forwardly declining guide wall 65, which is spaced above the ramp 55, to define a passage 66 through which the free end of the roll of strip 30 advances. The free end of the roll of strip 30 travels over the ramp 55. Depending from the guide wall 65 is a wall 70 that is spaced from the wall 60 of the casing 10 to define a passage 75 through which the free end of the roll of strip advances.

Figure 8:
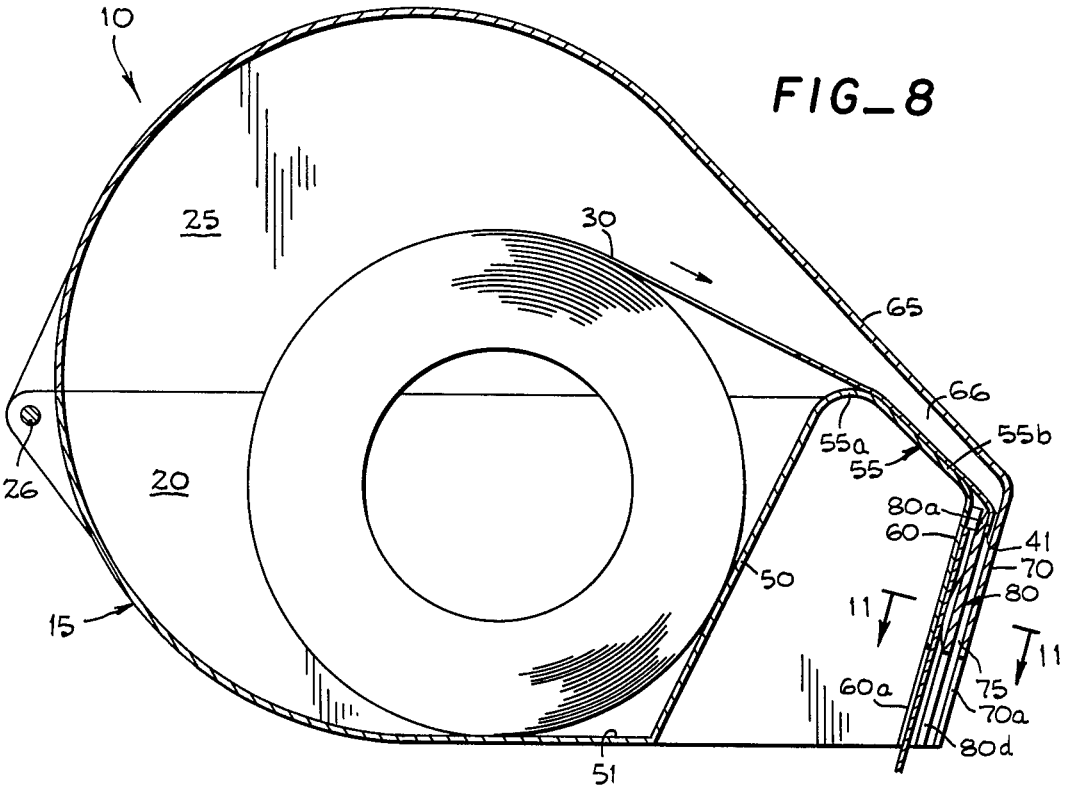
FIG. 8 is a vertical sectional view taken along line 2—2 of FIG. 1 illustrated with a roll of strip.
Figure 9:
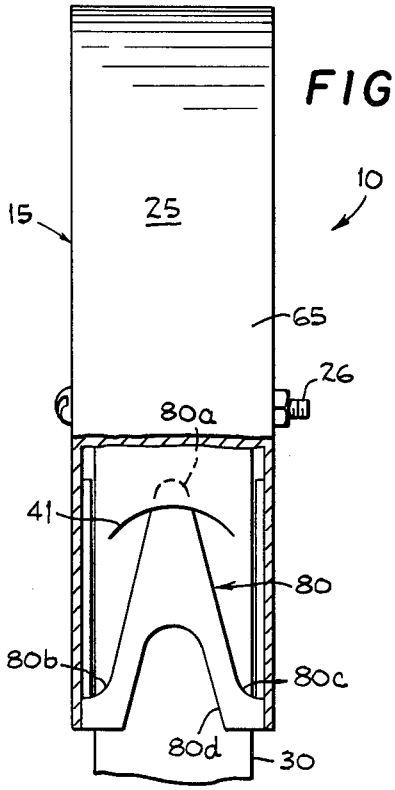
FIG. 9 is a vertical sectional view taken along line 6—6 of FIG. 1 illustrated with a roll of flexible strip.
Figure 11:
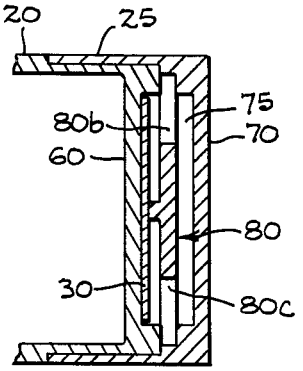
FIG. 11 is a horizontal section view taken along line 11—11 of FIG. 8 to illustrate the strip exit passage employed in the dispenser shown in FIGS. 1–6 and 8–10.

Mounted on the depending wall 70 of the cover 15 and disposed in the passage 75 is an upstanding member 80. The upstanding member 80 has a tip **80*a* that is suitable to enter a curved slit 40 of the free end of the roll of strip 30 as the free end of the roll of strip 30 advances from the passage 66 into the passage 75 under a pulling force applied to the free end of the roll of strip 30 by an operator. More particularly, the tip 80*a* is formed with a curved surface. The remainder of the upstanding member 80 is tapered outwardly and downwardly. As the free end of the roll of strip 30 advances, the tip 80*a* alternately penetrates successive slits 40–42 of the roll of strip 30 for indexing the free ends thereof. When a convex slit 40 enters the ticket exit passage 66, it opens into a convex opening to form a tongue (FIGS. 2 and 6) contacting the tip 80*a* of the upstanding member 80 as it enters the opening. When a concave slit 41 enters the ticket exit passage 66, it opens into a concave opening to form a pocket (FIGS. 8 and 9) penetrated by the tip 80*a* of the upstanding member 80. At each side of the ticket exit passage 66 at the location in which the tip 80*a* of the indexing member 80 penetrates a slit of the roll of strip 30 are transversely spaced tracks formed by the casing 20 and overlying transversely spaced guides formed by the cover 25, which serve to position the free end of the roll of strip in the ticket exit passage 66 to align the slit of the roll of strip 30 to be penetrated with the tip 80*a* of the indexing member 80. The bent portion of the casing 20 and the cover 25 which define the ticket exit opening and the entrance to the ticket exit passage 66 causes the free end of the roll of strip 30** to open the curved slit passing therebeyond to open for forming a convex opening or a concave opening depending on the configuration of the curved slit.

The upstanding member 80 has a base formed with knife-like severing surfaces **80*b* and 80*c* to sever the free end of the roll of strip from the roll of strip 30. The gradually sloping edges of the indexing member 80 between the tip 80*a* and the severing edges 80*b* and 80*c* serve to guide the free end of the roll of strip for severing by the edges 80*b* and 80*c*. As the operator continues to pull the free end of the roll of strip 30 downwardly, after the indexing operation, the increased width of the upstanding member 80 guides the free end of the roll of strip toward the edges 80*b* and 80*c* to sever the free end of the roll of strip from the roll of strip 30 along the curved slit, such as the slit 40, that was entered by the upstanding member 80 for the indexing operation. The upstanding member 80 also retards the egress of the strip of the roll of strip 30 trailing the free end of the roll of strip 30 from the housing 15 after the upstanding member 80 has entered the curved slit, such as the slit 40, in the free end of the roll of strip 30 and during the severing operation by obstructing the path of travel of the free end of the roll of strip trailing the slit indexed by the indexing member 80**.

The upstanding member 80 is formed with a slot **80*d* which is aligned with a slot 70*a* formed in the depending wall 70. A slot 60*a* is formed in the depending wall 60 which is aligned with the slots 80*d* and 70*a*. After the free end of the roll of strip 30 is severed, the succeeding free end of the roll of strip 30 will appear in the passage 75 to be gripped by an operator through the slots 70*a*, 80*d* and 60*a***.

The severing action of the free end of the roll of strip 30 from the roll of strip 30 is always along the curved slit that is indexed by the upstanding member 80. The actual severance occurs when the successive free end of the roll of strip is disposed in or below the vicinity of the slots **70*a*, 80*d* and 60*a***.

It is to be understood that the container and casing of the present invention may be designated and constructed in many different ways without departing from the spirit of the present invention.

I claim:

1. A dispenser for removing successively the free end of a roll of strip, said roll of strip being formed with slits at predetermined locations therealong, said dispenser comprising:

(a) a container in which is disposed the roll of strip, said container being formed with a strip exit location;

(b) downwardly directed means projecting from said container at said strip exit location for defining a downwardly directed passage through which the free end of the roll of strip advances;

(c) a track in said container at the entrance of said passage over which the free end of the roll of strip enters said passage, said track and said means being arranged to open a slit in said roll of strip advancing beyond said track into said passage; and (d) an elongated upwardly directed indexing member disposed in said passage and formed with a tip for entering an opening slit of the free end of the roll of strip advancing downwardly through said passage, said indexing member being formed to sever the free end of the roll of strip along the slit entered by said indexing member by the application of a force applied by an operator to the free end of the roll of strip, said indexing member being arranged to retard the egress of the strip trailing the free end of said roll of strip from said container during the severing of the free end of the roll of strip from the roll of strip by obstructing the path of travel of the strip of the roll of strip trailing the slit entered by said indexing member.

2. A dispenser as claimed in claim 1 wherein said container comprises a casing with an open top, and a cover pivotally connected to said casing to close the top of said casing when in a closed position, said cover being movable from a closed position to a retracted position to enable a roll of strip to be inserted into or removed from said casing.

3. A dispenser as claimed in claim 2 wherein said indexing member is formed with a curved tip and with an increased dimension below said tip for severing the free end of the roll of strip at the location of the slit indexed by said indexing member in response to an operator applying a force to the free end of the roll of strip, said indexing member being arranged to retard the egress of the strip trailing the free end of the roll of strip from said container during the severing of the free end of the roll of strip from the roll of strip.

4. A dispenser as claimed in claim 3 wherein said indexing member is formed with a base having sharp edges to sever the free end of the roll of strip.

5. A dispenser as claimed in claim 4 wherein said indexing member is formed with sloping edges between the tip and the base thereof to guide the free end of the roll of strip toward the base to sever the free end of the roll of strip.

6. In combination, a dispenser and a roll of strip:

A. said roll of strip comprising a plurality of curved slits formed along predetermined locations of said roll of strip, said curved slits being alternately convex and concave; and B. said dispenser comprising:

(a) a container in which said roll of strip is disposed, said container being formed with a strip exit location;

(b) downwardly directed means projecting from said container at said strip exit location for defining a downwardly directed passage through which the free end of the roll of strip advances;

(c) a track in said container at the entrance of said passage over which the free end of the roll of strip enters said passage, said track and said means being arranged to open a slit in said roll of strip advancing beyond said track into said passage; and (d) an elongated upwardly directed indexing member disposed in said passage for entering an opened slit of the free end of the roll of strip advancing downwardly through said passage, said indexing member being formed to sever the free end of the roll of strip along the curved slit entered by said indexing member by the application of a force applied by an operator to the free end of the roll of strip, said indexing member being arranged to retard the egress of the strip trailing the free end of the roll of strip from the container during the severing of the free end of the roll of strip from the roll of strip by obstructing the path of travel of the strip of the roll of strip trailing the slit entered by said indexing member.

7. The combination as claimed in claim 6 in which said indexing member enters alternately convex and concave curved slits for successive severing of the free ends of said roll of strip, each of said convex curved slits forms a convex opening in said passage forming a tongue contacting the tip of said indexing member when said indexing member penetrates the convex opening, each of said concave curved slits forms a concave opening in said passage forming a pocket penetrable by the tip of said indexing member.

8. The combination as claimed in claim 7 wherein said container comprises a casing with an open top, and a cover pivotally connected to said casing to close the top of said casing when in a closed position, said cover being movable from a closed position to a retracted position to enable a roll of strip to be inserted into or removed from said casing.

9. The combination as claimed in claim 7 wherein said indexing member is formed with a tip to enter a curved slit at the free end of said roll of strip advancing through said passage for indexing the location of the free end of the strip to be severed, said indexing member being formed with increased dimension below said tip for severing the free end of the roll of strip at the location of the slit indexed by said indexing member in response to an operator applying a force to the free end of the roll of strip, said indexing member being arranged to retard the egress of the strip trailing the free end of the roll of strip from said container during the severing of the free end of the roll of strip from the roll of strip, said indexing member entering alternately convex and concave curved slits during successive severing of the free end of the roll of strip.

10. The combination as claimed in claim 7 wherein said indexing member comprises a curved tip formed for entering alternately successive, alternately convex and concave curved slits during successive severing of the free end of said roll of strip.

11. The combination as claimed in claim 9 wherein said indexing member is formed with a base having sharp edges to sever the free end of the roll of strip.

12. A dispenser as claimed in claim 11 wherein said indexing member is formed with sloping edges between the tip and the base thereof to guide the free end of the roll of strip toward the base to sever the free end of the roll of strip.

* * * * *